United States Patent [19]

Hahn et al.

[11] 4,377,387

[45] Mar. 22, 1983

[54] DELIMING HIDES

[75] Inventors: Erwin Hahn, Heidelberg; Dietrich Lach, Friedelsheim; Kurt Schneider, Duerkheim; Rainer Strickler, Heidelberg; Rolf Streicher, Worms, all of Fed. Rep. of Germany

[73] Assignee: BASF Aktiengesellschaft, Ludwigshafen, Fed. Rep. of Germany

[21] Appl. No.: 348,277

[22] Filed: Feb. 12, 1982

[30] Foreign Application Priority Data

Mar. 6, 1981 [DE] Fed. Rep. of Germany ..... 3108428

[51] Int. Cl.[3] ..... C14C 1/08

[52] U.S. Cl. ..... 8/94.17; 8/94.18

[58] Field of Search ..... 8/94.17, 94.18

[56] References Cited

U.S. PATENT DOCUMENTS 4,213,760 7/1980 Hahn et al. ..... 8/94.17

FOREIGN PATENT DOCUMENTS 804827 4/1951 Fed. Rep. of Germany .

*Primary Examiner*—Maria Parrish Tungol

*Attorney, Agent, or Firm*—Oblon, Fisher, Spivak, McClelland & Maier

[57] ABSTRACT

Conventionally limed hides are delimed for from one to six hours under conventional deliming conditions in respect of liquor length, temperature and pH of the liquor, by a process in which a cyclic carbonate of a polyhydric aliphatic alcohol of 2 to 6 carbon atoms is employed as the active agent.

4 Claims, No Drawings

DELIMING HIDES

The present invention relates to a process for deliming hides, wherein a cyclic carbonate of a polyhydric aliphatic alcohol is employed as a safety deliming agent, thereby avoiding the disadvantages associated with an overdosage of the conventional deliming agents.

The liming of hides to unhair them and to open them up in the production of leather is effected in an alkaline medium, using inorganic or organic sulfides in most cases. Lime, as a rule alone but occasionally mixed with caustic soda or sodium carbonate, is usually employed as the alkaline agent. The material must subsequently be freed from the liming chemicals, in particular the lime, ie. it must be delimed, in preparation for further processing. The deliming is conventionally effected using an acid or an acidic salt, eg. phthalic acid, sulfophthalic acid, formic acid, acetic acid, boric acid, aliphatic dicarboxylic acid mixtures, hydrochloric acid or sulfuric acid, or ammonium salts thereof. The conventional conditions for this process are as follows. Liquor length: from 0 to 300%, preferably from 0 to 200%, based on the weight of the hides; temperature: from 5° to 38° C., preferably from 25° to 35° C.; pH in the liquor at the end of the process: from 6 to 8.7; and deliming time: from 1 to 5, preferably from 1 to 3, hours.

A serious disadvantage of the prior art deliming processes arises as follows:

The amount of chemicals required for deliming depends to a great extent on the contents of lime and any other basic compounds, eg. sodium sulfide and sodium hydroxide, in the hides. Since these contents always vary, exact metering of the deliming chemicals is extremely difficult in practice. Overdosage therefore occurs easily, with the result that the pH at the beginning of deliming is decreased to the isoelectric point of the albumin (pH about 5) or even below this value. Thus, albumin substances which have dissolved during liming are precipitated, with or without other dissolved dirt. They are deposited on the surface of the hides in a form which is difficult to remove, have an adverse effect on the appearance of the material and cause difficulties in subsequent processing stages, in particular in the dyeing process. The handle of the material is also adversely affected. Attempts hitherto made to overcome this problem involved the use of ammonium salts as the safety deliming agent, but since the pH of aqueous ammonium salt solutions can be below 5 even these agents do not provide the desired safety. In addition, the use of ammonium salts also causes problems from the ecological point of view, since ammonium salts are not completely degraded in sewage plants, and thus increase the COD value of the waste water.

The use of butyrolactone as a deliming agent has been disclosed in German Pat. No. 804,827. However, this inner ester hydrolyzes very slowly under the conventional deliming conditions, and the required deliming periods are therefore very long. Probably for this reason, butyrolactone has not been introduced industrially.

Finally, U.S. Pat. No. 4,213,760 describes a process employing esters which hydrolyze under the deliming conditions. These esters overcome the above disadvantages of the conventional deliming agents by not permitting the pH to fall below 5 and by being free of ammonium salts. However, overdosages of even these esters leads to an unavoidable liberation of hydrogen sulfide which, since it is very toxic, makes this possible method one which involves a continual latent danger to the life of the personnel, apart from the odor nuisance.

It is an object of the present invention to develop a deliming process which not only avoids the above disadvantages of the conventional deliming agents but is also certain to avoid the evolution of hydrogen sulfide.

We have found that this object is achieved by the process according to the invention. Surprisingly, we have found that of all the esters investigated only the cyclic esters (5-membered and 6-membered rings) of polyhydric aliphatic alcohols and carbonic acid are useful for achieving the above object. When these esters are used, the pH does not fall below 7.5 even in the case of a large overdosage, so that hydrogen sulfide is not liberated in dangerous amounts, whereas when other esters are used the pH can certainly decrease to below 7.5, hydrogen sulfide escaping in amounts such that frequently $H_2S$ concentrations of 2,000 ppm can be measured above the deliming liquor. Amongst the cyclic carbonates of polyhydric aliphatic alcohols, which carbonates are employed according to the invention, those are preferred whose equivalent weights (based on the carbonic acid component and not on the alcohol component) are less than 150, preferably less than 100, in particular less than 60. Accordingly, suitable carbonates are the dicarbonates (which may or may not contain hydroxyl groups which are still free) of polyhydric aliphatic alcohols of 2 to 6, preferably of 2 to 3, carbon atoms, i.e. alcohols containing more than one, preferably from 2 to 3, in particular 2, hydroxyl groups, 2 or more hydroxyl groups being located 1,3, or preferably 1,2, to one another, for example the cyclic carbonates of butane-1,2-diol, butane-2,3-diol, neopentylglycol and glycerol, the dicarbonate of pentaerythritol (spiro compound), and, preferably, the cyclic carbonates of ethylene glycol and propylene 1,2-glycol.

The carbonates are prepared in a conventional manner, for example by reacting the alcohol with phosgene or, preferably, an epoxide with carbon dioxide.

The lime contained in the liming mixture hydrolyzes the carbonate until a pH of from 7.8 to 7.5 is reached, depending on the excess of carbonate. The lime is converted to calcium bicarbonate, which dissolves, and the hydrolysis then stops. In no experiment did the pH fall below 7.5. The selected range is optimal since it ensures that no hydrogen sulfide escapes from the solution, while the pH is no higher than is absolutely necessary for avoiding the formation of hydrogen sulfide. An excessive pH is also undesirable with respect to the smoothness of the grain and the handle of the leather as well as the safety of the deliming process.

The amount of carbonate employed depends on the amount of lime and other basic compounds (eg. sodium sulfide and sodium hydroxide) in the hide material, and is from 0.8 to 4%, preferably from 1 to 2%, based on the weight of the wet hides.

The carbonates are preferably dissolved in water. Carbonates which are not sufficiently water-soluble can be emulsified or dispersed in the conventional manner, using cationic, anionic or non-ionic emulsifiers. The operation is not at all difficult.

Parts and percentages mentioned in the Examples are by weight.

EXAMPLE 1

136 Parts of limed cattle flanks of split thickness 3.5–4.5 mm were first washed with 408 parts of warm water at 35° C. for 20 minutes by drumming. The wash liquor was completely drained off, and thereafter 3.4 parts of propylene 1,2-carbonate and 0.3 part of a commercial wetting agent based on an alkylsulfonate were added. After the material had been drummed for 5 minutes, the pH of the new liquor resulting from the depletion of the pelt was monitored and found to be 8.7. 20 minutes after addition of the deliming agent, the liquor had a pH of 7.9 and the pelt was about 50% delimed on average at this time. After a further 20 minutes, the pH was 8.0 and the pelt was 70% delimed. After a further 80 minutes, the deliming process was complete and the pH was 8.2.

COMPARATIVE EXPERIMENT

Example 1 was repeated in exactly the same manner, except that a commercial product based on ammonium sulfophthalate was employed as the deliming agent. After 5 minutes' drumming, the pH of the deliming liquor was measured as 3.2, increasing to 7 after 15 minutes and reaching an end pH of 8.6 after 40 minutes' drumming.

Comparison of the delimed pelts showed that those of Example 1 were substantially cleaner and thus paler than those of the Comparative Experiment.

The Examples which follow were carried out in a manner similar to that of Example 1. In each case, 100 parts of cattle pelt were delimed. The experimental results are summarized in the Table.

All delimed pelts were extraordinarily clean and pale.

TABLE

| Example No. | 2 | 3 | 4 |
|---|---|---|---|
| Deliming agent | 1 part of ethylene carbonate | 1.3 parts of glycerol carbonate | 1.3 parts of propylene 1,2-carbonate |
| Wetting agent | — | — | 0.5 part of alkyl-sulfonate |
| Degree of deliming after | | | |
| 40 minutes | 50% | 80% | 50% |
| 120 minutes | 100% | 100% | 100% |
| pH after | | | |
| 5 minutes | 7.5 | 8.6 | 8.3 |
| 20 minutes | 7.7 | 8.7 | 8.5 |
| 40 minutes | 7.9 | 8.6 | 8.5 |
| 120 minutes | 8.0 | 8.3 | 8.2 |

We claim:

1. A process for deliming a conventionally limed hide for from one to six hours under conventional deliming conditions in respect of liquor length, temperature and pH of the liquor, wherein a cyclic carbonate of a polyhydric aliphatic alcohol of 2 to 6 carbon atoms is employed as the active agent.

2. A process as claimed in claim 1, wherein a cyclic carbonate having a molecular weight of less than 300 is employed.

3. A process as claimed in claim 1, wherein a cyclic carbonate having a molecular weight of less than 120 is employed.

4. A process as claimed in claim 1, wherein the cyclic carbonate of ethylene glycol or propylene 1,2-glycol is employed.

* * * * *